US005680822A

United States Patent [19]

Hallberg

[11] Patent Number: 5,680,822

[45] Date of Patent: Oct. 28, 1997

[54] SOLID FUEL BURNER

[76] Inventor: Jörgen Hallberg, Pl. 7203, S-714 00 Kopparberg, Sweden

[21] Appl. No.: 495,498

[22] PCT Filed: Jan. 28, 1994

[86] PCT No.: PCT/SE94/00069

§ 371 Date: Jul. 27, 1995

§ 102(e) Date: Jul. 27, 1995

[87] PCT Pub. No.: WO94/17331

PCT Pub. Date: Aug. 4, 1994

[30] Foreign Application Priority Data

Jan. 28, 1993 [SE] Sweden ..... 9300265

[51] Int. Cl.[6] ..... F23C 1/10

[52] U.S. Cl. ..... 110/261; 110/264; 110/265; 110/104 B; 431/187

[58] Field of Search ..... 110/104 B, 110, 110/108, 293, 260–265; 431/187

[56] References Cited

U.S. PATENT DOCUMENTS

| | | | |
|---|---|---|---|
| 1,726,870 | 9/1929 | Trent | 110/261 |
| 1,769,197 | 7/1930 | Wetmore | 110/104 B |
| 1,945,850 | 2/1934 | Filmer | 110/293 X |
| 2,932,712 | 4/1960 | Levin | 110/110 |
| 4,096,808 | 6/1978 | Trickel | 110/264 X |
| 4,803,836 | 2/1989 | Blanton et al. | 110/110 X |
| 5,010,831 | 4/1991 | Halfhide | 110/110 X |
| 5,517,929 | 5/1996 | Repnik et al. | 110/293 X |

FOREIGN PATENT DOCUMENTS

| | | | |
|---|---|---|---|
| 0346531 | 12/1989 | European Pat. Off. . | |
| 0415539 | 3/1991 | European Pat. Off. . | |
| 3727006 | 2/1989 | Germany . | |
| 3247242 | 5/1991 | Germany . | |
| 154069 | 4/1986 | Norway . | |
| 86/01726 | 12/1986 | WIPO | 110/104 B |

*Primary Examiner*—Henry A. Bennett
*Assistant Examiner*—Susanne C. Tinker
*Attorney, Agent, or Firm*—Ostrolenk, Faber, Gerb & Soffen, LLP

[57] ABSTRACT

A solid fuel burner mountable on a boiler furnace. The forward portion of the burner is insertable through an opening in the casing of the furnace so as to extend into the furnace's combustion zone. The burner includes a tubular main body accommodating a feed screw for the solid fuel. The free end of the screw terminates in the forward portion of the burner. The other, closed end of the burner is mounted rotatably in a bearing. A drive rotates the feed screw inside the main body. An ignition chamber is disposed at the forward end portion. One open end of the ignition chamber meets up with the main body and the feed screw terminating within the chamber. An air supply duct with its delivery end in the chamber supplies combustion air to the fuel. An inlet in the main body gives access to the screw and thus permits the supply of fuel from a solid fuel container to the feed screw.

11 Claims, 2 Drawing Sheets

SOLID FUEL BURNER

BACKGROUND OF THE INVENTION

1. Field of the Invention

The present invention relates to a burner for solid fuel, e.g. in the form of pellets, and is intended for mounting on a boiler furnace, the forward portion of the burner being insertable through an opening in the furnace casing such as to extend into the combustion zone of the furnace.

2. Description of the Related Art

During recent years the use of different alternatives to oil firing has become more and more usual, especially for heating dwellings. In such cases, wood chips or other solid fuel have come into use, a suitable arrangement being adopted to feed the fuel to the combustion zone in the furnace. In order to avoid a costly and laborious installation, new types of burner have been developed for these alternative fuels, and these burners can complement an existing oil burner, or be mounted on the furnace in its stead.

A problem with the new varieties of burners is obtaining a regulated, continuous and disturbance-free feed of the solid fuel to the combustion zone of the furnace, without unnecessary breakdown in operation, as well as complete combustion of the fuel.

SUMMARY OF THE INVENTION

The object of the present invention is to achieve a burner of the kind mentioned above, where the mentioned problems have been eliminated, while at the same time it is simple in construction and cheap to produce. The distinguishing features of the invention are disclosed in the accompanying claims.

Due to the inventive burner there is now obtained very reliable, disturbance-free and continuous feeding of the solid fuel towards the combustion zone in the furnace. Since there is a very effective mixture of primary combustion air and fuel, the air being blown towards the combustion zone, and since this is in combination with slow rotation of the burner ignition chamber, very effective combustion is obtained for the furnace. Secondary air is fed to the forward part of the ignition chamber, and in this way the temperature inside the chamber can be controlled by balancing the primary air with the secondary air, while rotation of the chamber prevents ash from collecting in it. So as to further eliminate any build-up of ash in the chamber, it may be provided with a plurality of helically formed ridges or fins extending towards its opening. The use of a separate feed means that freely deposits the fuel at the inlet of a feed screw included in the burner ensures that back-firing is prevented, which could occur should there be operational stoppages or disturbances.

BRIEF DESCRIPTION OF THE DRAWINGS

The invention will now be described in more detail, with the aid of some embodiment examples, and with reference to the accompanying drawings, where.

DETAILED DESCRIPTION OF THE PREFERRED EMBODIMENTS

Figure 1:
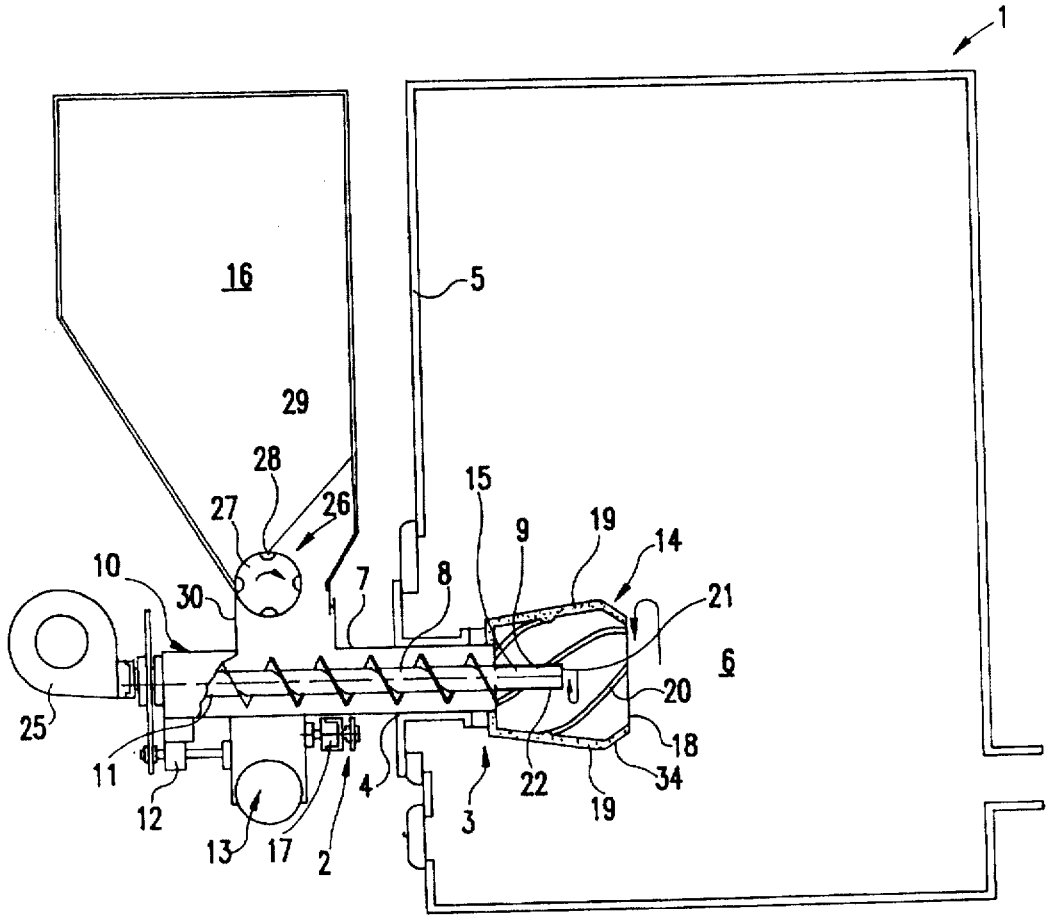
FIG. 1 is a schematic cross-section in elevation of a solid fuel burner in accordance with the invention, where it is mounted on a boiler furnace.

In FIG. 1 there is illustrated a preferred embodiment of a solid fuel burner 2, preferably for pellets. The burner is mounted instead of an oil burning unit on a boiler furnace 1. The forward portion 3 of the burner 2 is inserted in an opening 4 in the casing 5 and extends into the combustion zone 6 of the furnace 1. To advantage, the fuel may be pellets, which may comprise timber waste such as bark, sawdust and the like.

The burner 2 includes a tubular body 7, through which extends a feed screw 8 for feeding the fuel through the body. The free end 9 of the screw 8 terminates in the forward portion 3 of the burner 2, and the opposite, closed end 10 of the screw 8 is rotatably carried by a bearing 11. Rotation of the screw 8 is enabled via a drive means 12 by a motor situated in a housing 13 fixed to the body. In certain applications of the invention, the forward, free end 9 of the screw 8 may be arranged stationarily, in which case the screw 8 may be attached to a separate, unillustrated tube mounted for rotation on the tube forming the air supply duct 15. An ignition chamber 14 is disposed on the forward portion 3 of the burner 2, the chamber 14 accommodating the end of the screw 8 and is connected to the open end of the body 7. This chamber 14 is also in communication with the duct 15, which supplies it with primary air for enabling fuel combustion. The solid fuel is stored in a container 16 mounted on the body 7 and is taken to the feed screw 8 via an inlet 30 in the body.

To obtain favorable ignition and combustion of the solid fuel the ignition chamber 14 is rotatably mounted at the forward portion 3 of the burner 2. An unillustrated motor disposed in the motor housing 13 is coupled to a drive means 17 for causing the ignition chamber 14 to rotate very slowly, e.g., 1 rpm, the motor rpm being regulatable to obtain optimum rotational speed of the chamber in relation to combustion. As will be seen from the drawing, the ignition chamber 14 is somewhat conical in shape, with wall portions 19 diverging towards its open end 18. On the inside of the chamber body these portions are provided with at least one helical fin or ridge 20. When the chamber body is mounted horizontally, it can be implemented with a radially inwardly directed flange 34 for preventing incompletely combusted fuel from prematurely falling out of the chamber. In the example illustrated in FIG. 1, the duct 15 extends the full length of the hollow screw shaft, including the closed portion 10 of screw 8 and burner body 7, connection to a blower 25 being arranged at portion 10. The blower 25 is fixed to the body 7 and adapted to blow primary air through the duct 15 to the free forward end 9 of the screw shaft, which does not have any helical flight in this region. The shaft end is closed off by an end wall 21, and its forward end portion 9 is perforated with a plurality of combustion air exit holes 22. In some cases the end wall 21 may also be provided with air exit holes 22 for combustion air.

Figure 2:
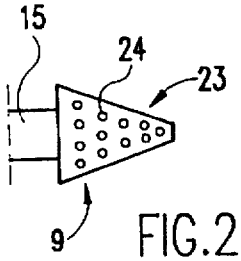
FIG. 2 illustrates an alternative embodiment example of the forward part of the feed screw implemented as a cone, with holes for the passage of primary air.

In an alternative embodiment illustrated in FIG. 2, the screw free end 9 is implemented in the form of a cone 23, with its curved surface having the openings 24 of obliquely forwardly directed air exit ducts and decreasing diameter towards the mouth of the ignition chamber 14. The blower 25 can of course be disposed remote from the burner 2, in which case there is a suitable connection means between them.

A fuel feed regulating means 26 can be disposed between the fuel container 16 and burner 2 for adjusting the amount of fuel fed to the screw 8. The means 26 includes a rotatable wheel 27, which may be driven by an unillustrated motor at a desired revolutionary rate. In the periphery of the wheel 27 there are a plurality of recesses 28 arranged consecutively, and with the aid of a guide plate 29 in the container 16, the recesses catch given amounts of fuel and deliver them to the feed screw 8 via the inlet 30.

Figure 3:
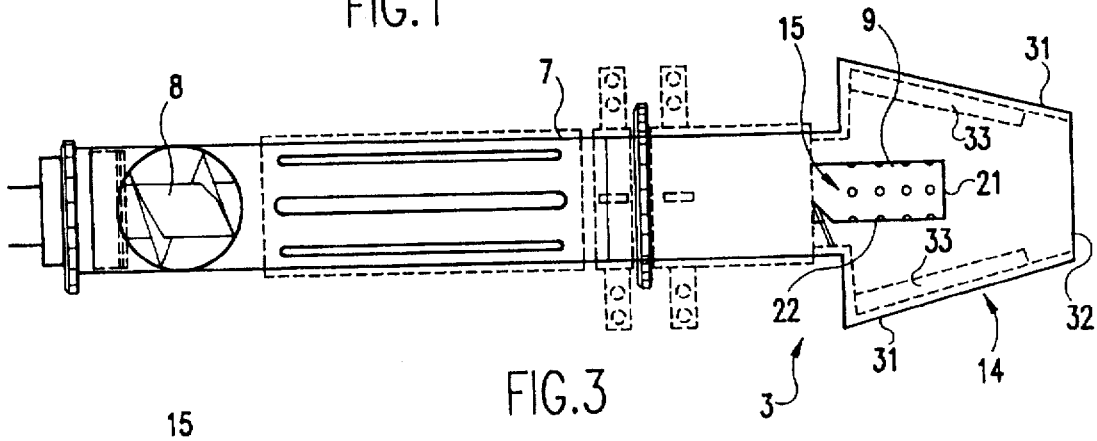
FIG. 3 illustrates an alternative embodiment of an ignition chamber.

In FIG. 3 there is illustrated an alternative embodiment of the ignition chamber 14 for the burner 2. Here, the chamber 14 is given a conical shape, the wall 31 of which converges towards its opening 32. Helically extending fins 33 can be fixed to the inside of the wall 31 to prevent ash building up in the chamber 14.

Figure 4:
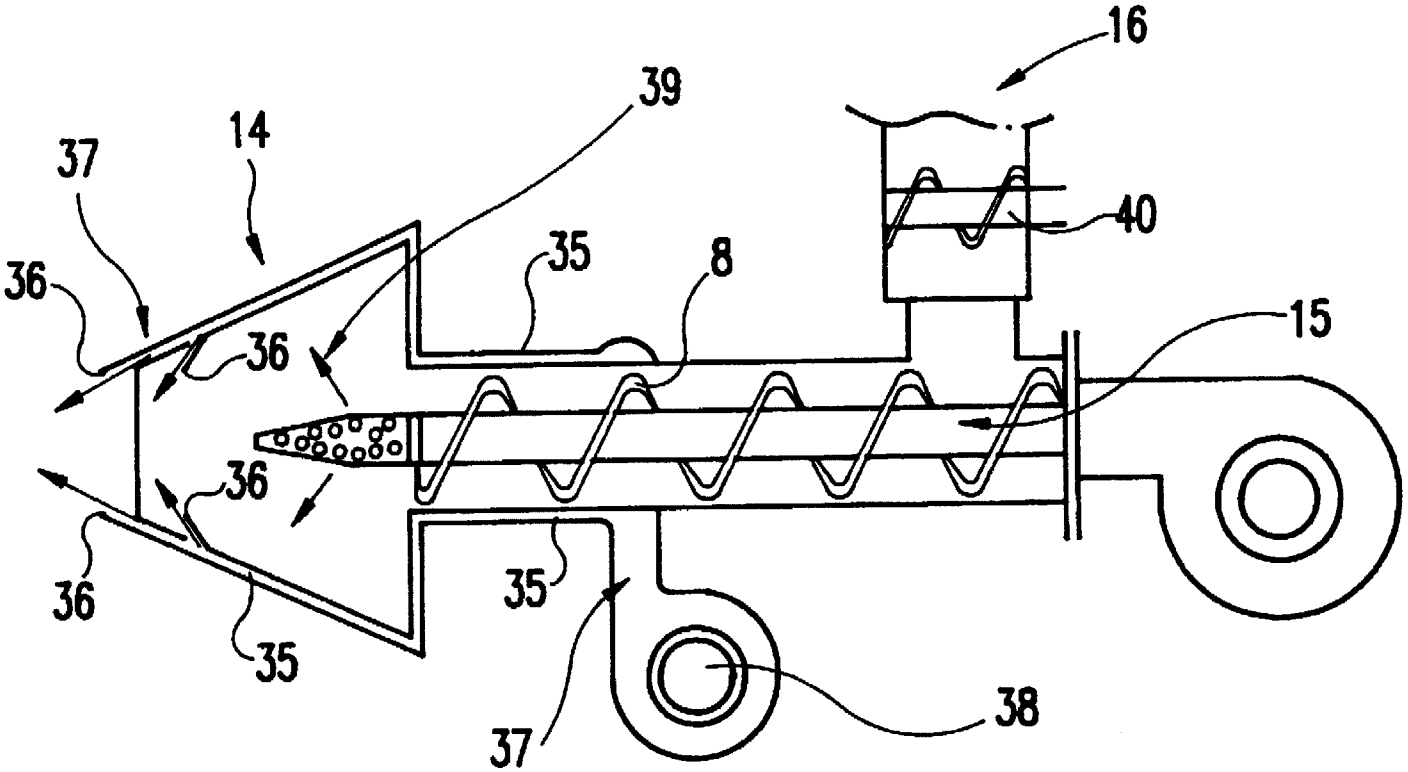
FIG. 4 is a schematic cross-section in elevation of another alternative embodiment of the inventive burner.

In FIG. 4 there is an illustration of an inventive burner embodiment where the ignition chamber body is arranged with an exterior duct system 35 comprising at least one annular duct 35 with openings 36 into the ignition chamber and at the mouth of it. Secondary air 37 is blown into the system from a secondary blower 38 and this air will be preheated by the chamber body as it passes through the system 35 until it reaches the outlet openings 36.

Temperature in the ignition chamber 14 can be regulated by the preheated secondary air 37 so that it does not get too high, and this is effected by balancing the primary air 39 coming through the air supply duct 15 against the secondary air 37, thus obtaining optimum combustion. In this example the solid fuel is delivered to the feed screw 8 via a fuel regulating device in the form of a small dosing screw 40.

I claim:

1. A burner for solid fuel, intended for mounting on a boiler furnace having a furnace casing, the burner having a forward portion being insertable through an opening in the furnace casing and extending into a combustion zone of the furnace, the burner including a tubular main body accommodating a feed screw for the fuel, a free end of the screw terminating in the forward portion and its other, closed end being rotatably mounted in a bearing, a drive means for rotating the feed screw inside the body, an ignition chamber disposed at the forward portion of the burner body with the feed screw end and an air supply duct terminating in the chamber for supplying primary air for ignition and combustion of the fuel, and an inlet in the main body for access to the feed screw for delivering solid fuel from a fuel container to the feed screw, wherein the air supply duct for primary combustion air is formed in, and extends through the center of the feed screw and terminates inside the ignition chamber; and wherein a free forward end of the air supply duct and the feed screw As in the form of a cone converging in a forward direction, with a curved surface having obliquely, forwardly directed ducts with exit holes for primary combustion air.

2. Burner as claimed in claim 1, wherein the free forward end of the air supply duct has the form of a tube stationarily disposed relative to the feed screw, with its end closed off by an end wall and its periphery perforated by a plurality of holes for the passage of primary combustion air.

3. Burner as claimed in claim 1, wherein at the closed portion of the feed screw and main body the air supply duct is connected to a blower carried by the body and adapted to blow air into the air supply duct.

4. Burner as claimed in claim 1, wherein a fuel feed regulating means is disposed between the fuel container and feed screw for regulating the amount of fuel supplied per time unit to the burner.

5. Burner as claimed in claim 4, wherein the regulating means comprises a rotatable wheel, in the periphery of which there are a plurality of consecutive recesses, there being a guide plate in the container arranged so as to direct fuel toward the recesses such that the recesses catch given amounts of fuel for delivery in portions to the feed screw via the inlet.

6. A burner for solid fuel, intended for mounting on a boiler furnace having a furnace casing, the burner having a forward portion insertable through an opening in the furnace casing and extending into the combustion zone of the furnace, the burner including a tubular main body accommodating a feed screw for the fuel a free end of the screw terminating in the forward portion and its other, closed end being rotatably mounted in a bearing, a drive means for rotating the feed screw inside the body, an ignition chamber disposed at the forward portion of the burner body with the feed screw end and an air supply duct terminating in the chamber for supplying primary air for ignition and combustion of the fuel, and an inlet in the main body for access to the feed screw for delivering solid fuel from a fuel container to the feed screw.

wherein the air supply duct for primary combustion air is formed in, and extends through the center of the feed screw and terminates inside the ignition chamber; and wherein along a curved surface the body of the ignition chamber has at least one duct for secondary air which, in a preheated state and assisted by a blower can be fed out from exit openings in the forward portion of the ignition chamber, the secondary air and the primary combustion air supplied via the air supply duct being adjustable for regulation of the temperature in the ignition chamber.

7. The burner as claimed in claim 6, wherein the free forward end of the air supply duct has the form of a tube stationarily disposed relative to the feed screw, with its end closed off by an end wall and its pluralitry perforated by a plurality of holes for the passage of primary combustion air.

8. The burner as claimed in claim 6, wherein a free forward end of the air supply duct and the feed screw is in the form of a cone converging in a forward direction, with a curved surface having obliquely, forwardly directed ducts with exit holes for primary combustion air.

9. The burner as claimed in claim 6, wherein at the closed portion of the feed screw and main body the air supply duct is connected to a blower carried by the body and adapted to blow air into the air supply duct.

10. The burner as claimed in claim 6, wherein a fuel feed regulating means is disposed between the fuel container and feed screw for regulating the amount of fuel supplied per time unit to the burner.

11. The burner as claimed in claim 9, wherein the regulating means comprises a rotatable wheel, in the periphery of which there are a plurality of consecutive recesses, there being a guide plate in the container arranged so as to direct fuel to the recesses such that the recesses catch given amounts of fuel for delivery in portions to the feed screw via the inlet.

* * * * *